US006030134A

United States Patent [19]

Stewart

[11] Patent Number: 6,030,134

[45] Date of Patent: Feb. 29, 2000

[54] EDIBLE PAPER PRINTER

[75] Inventor: Douglas R. Stewart, Fort Gratiot, Mich.

[73] Assignee: Jack Guttman, Inc., West Chester, Ohio

[21] Appl. No.: 09/211,552

[22] Filed: Dec. 15, 1998

[51] Int. Cl.[7] ..... B41J 11/48

[52] U.S. Cl. ..... 400/600.2; 400/608.1; 400/601; 101/35

[58] Field of Search ..... 400/601, 608.1, 400/595, 600.1, 600.2, 605, 611, 613.1, 578; 101/35, 43, 44

[56] References Cited

U.S. PATENT DOCUMENTS

| | | | |
|---|---|---|---|
| 5,141,344 | 8/1992 | Murakami et al. | 400/579 |
| 5,427,462 | 6/1995 | Jackson et al. | 400/579 |
| 5,733,638 | 3/1998 | Tsukioka | 428/209 |
| 5,738,454 | 4/1998 | Zepeda et al. | 400/625 |
| 5,795,087 | 8/1998 | Brower et al. | 400/636 |

FOREIGN PATENT DOCUMENTS 802 064 10/1997 United Kingdom .

*Primary Examiner*—John S. Hilten
*Assistant Examiner*—Dave A. Ghatt
*Attorney, Agent, or Firm*—Wood Herron & Evans LLP

[57] ABSTRACT

A printer (10) is modified to effectively remove the center tension rollers (154', 254', or 354') so as to avoid adversely impinging on edible paper (14) along the paper path (32) of the printer (10). A tray (282) may provide a wall (290) to define an offset from an outboard edge (232) of the paper path (32) so as to align a substrate (18) supporting the edible paper (14) with a paper-free margin (22) under an outboard tension roller (154, 254, 354) rather than the edible paper (14). A portion (O) of an outboard roller (354) may be thickened to elevate an inwardly portion (I) thereof off from adversely impinging on edible paper (14) passing thereunder.

30 Claims, 6 Drawing Sheets

EDIBLE PAPER PRINTER

BACKGROUND OF THE INVENTION

I. Field of the Invention

The present invention relates to printers and more particularly to modifications to printers by which to apply images to edible paper such as to produce a decoration which can be placed directly onto an iced baked good, e.g., a cake with frosting, and eaten with the baked good.

II. Description of Prior Art

Cake and other baked good decorations are quite popular, especially among children. Such decorations typically consisted of hand-applied icing-based decorations and/or miniature toys placed onto the icing or frosting. More recently, in an attempt to satisfy commercial bakers, attempts have been made at providing mass produced decorations which minimize the need for the time and labor-intensive icing applications. Chief among such attempts is the decorated edible substrate sheet such as shown in U.S. Pat. No. 5,017,394 which is made by a silk screening process. As is well understood, the silk-screen process requires that the desired image be formed into several screens, one for each color. The screens are then used as templates to reproduce the image on the substrate by forcing edible coloring materials through the screen openings. The substrate may be placed on an iced or frosted cake and eaten therewith.

While the silk-screen printing process produces a decoration, that process is still somewhat time and labor-intensive. Moreover, with the silk screen process, the range of decorated designs has been somewhat limited. As the design must be formed into multiple screens, make-ready costs and inventory restraints limit the number of pre-made designs that will be on hand. Additionally, the silk screen process is an inherently low resolution process.

Many consumers are not satisfied with the limited design choices available. Indeed, many consumers would prefer to customize the decorations but cannot readily do so. By way of example, iced or frosted cakes having a decoration that depicts the face of the birthday child would be highly desirable. The silk screen process, however, is economically unsuitable for one-off or custom designs. Instead, such a decoration may be provided by placing the actual photograph or a reproduction thereof onto the icing. But the photograph or reproduction is not edible and so must be removed before the iced cake can be eaten.

An improvement to the photograph has been to provide a costly and complex cake printing system. In such a system, an electronic scanner digitalizes a photographic image, and a separate, electronic computer device drives a printer that sets over the iced cake to form the image directly on the cake. Not only is such a system slow, it requires several costly computer components. Moreover, the icing on the cake must be nearly perfectly flat so as not to impact or foul up the printer mechanism. The task of properly icing a cake for such a device is quite difficult and prone to error requiring greater sophistication on the part of the icer.

In an attempt to reduce the complexities involved with printing directly on to the icing, edible paper has been developed onto which the scanned or a stored image may be printed, such as with a conventional ink jet printer supplied with edible inks. The paper, bearing the printed image thereon, may then be placed directly onto the icing thereby decorating the baked good. Utilizing conventional printers to apply images to edible paper is much easier and eliminates the need to carefully ice the cake, and so may be seen as providing a cost-effective way of applying a wide range of color images to baked goods. Unfortunately, some of the very characteristics of edible paper which make it desirable for use on icing, present problems when the edible paper passes through the paper path of conventional printers. In particular, edible paper may be damaged by the paper-drive system typical of such printers leading to waste and increased cost. Moreover, the edible paper may tend to become jammed in the printer. While a jam with conventional paper is generally nothing more than an annoyance and can usually be cleared by even novice users, edible paper tends to adhere to the printer mechanisms and can become lodged in the printer requiring potentially time-consuming or expensive repairs, and could require attention from a skilled technician.

SUMMARY OF THE INVENTION

The present invention provides method and apparatus, such as modifications to conventional printers, by which to reduce problems encountered as edible paper passes through the paper path of the printer. In this regard, a conventional printer typically includes a driven roller and a tension roller array which cooperate to grip the paper therebetween and propel the paper lengthwise through the paper path. The tension roller array typically includes a plurality of tension rollers spaced across the width of the paper path. The tension roller array also typically includes one or more bias mechanisms, such as springs, which independently or collectively urge the tension rollers toward the driven rollers. The outboard-most tension rollers will engage the lateral peripheral edges of the paper, while the remaining or center tension rollers are to engage the central portion of the paper. When edible paper is the media to be transported through the paper path, impingement thereof by the center rollers (as brought about due to the bias mechanisms) is determined to be a major cause of damage or distortion of the paper. To this end, and in accordance with the principles of the present invention, the printer is modified such that one or more of the central tension rollers do not adversely impinge the edible paper. Such a modification can be accomplished either directly, such as by removal of the desired central tension roller(s), or indirectly, such as by overcoming or removing the bias mechanism(s) associated with the desired central tension roller(s). At least one, if not both, of the outboard rollers and associated bias mechanisms, are, however, left in place so as to propel the paper along the paper path by impingement along the peripheral lateral edge(s) of the paper, but with little or no impingement of the central surface of the edible paper.

Edible paper having desirable characteristics for decorating iced cakes is advantageously provided on a supporting substrate from which the printed paper may be removed for application to the icing of a cake, for example. The substrate serves as a support for the paper such as in the manufacture of the paper as well as for storage and handling, and transport into and through the paper path of a printer. Moreover, the edible paper is advantageously sized smaller than the substrate so as to define a lateral margin of the substrate devoid of the edible paper along the lateral peripheral edge of the substrate. In accordance with a further feature of the printer invention, only the outboard tension rollers which overlie the substrate margin are left such that the edible paper is propelled through the paper path by impingement of the outboard tension rollers with primarily only the substrate margin and generally without impingement of the edible paper on the substrate.

In same case, one or more of the outboard tension roller(s) are wider than the substrate margin and so would tend to impinge the edible paper adjacent the substrate margin. To further protect the edible paper, and in accordance with a further feature of the present invention, a portion of the outboard tension roller overlying the area through which the substrate margin will pass is thickened so as to enlarge the diameter of the tension roller thereat. The thickened portion impinges against the substrate margin to assist in propelling the substrate and edible paper through the paper path while elevating the rest of the tension roller above the substrate so as to reduce or eliminate impingement against the edible paper adjacent the substrate margin. The tension roller may be thickened by addition of a concentric sleeve over the selected portion.

In addition to the foregoing, many printers fix the position of one lateral edge of the inlet to the paper path, such as by a wall of the printer adjacent thereto, and include an adjustable stop by which to selectively adjust the position of the opposite lateral edge of the inlet to the paper path. As a consequence, the width of the paper path inlet is adjustable, thereby allowing use of the printer with the many various widths of standard paper encountered in typical use. With edible paper, jams may occur from misalignment or improper use of the adjustable stop. Additionally, it may be desirable to offset the edge of the substrate from the fixed lateral edge of the printer so as to reduce the amount of potential overlap between the associated outboard tension roller and the edible paper adjacent the substrate margin. Such an offset may, additionally, reduce or eliminate the need to thicken a portion of the associated outboard tension roller. To these ends, and in accordance with a yet further feature of the present invention, the width of the inlet is fixed to match the width of the substrate to be used with the printer. The width can be fixed such as by fixing the adjustable stop, or by application of a fixed-width supplemental tray adjacent to the paper path inlet. The latter allows independent fixing of both lateral edges which has the advantage that the substrate may also be offset from the normally fixed inlet edge so as to reduce the area of overlap between the paper and the adjacent outboard tension roller of the tension roller assembly.

By virtue of the foregoing, there is thus provided method and apparatus, such as modifications to conventional printers, by which to reduce problems encountered as edible paper passes through the paper path of the printer. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
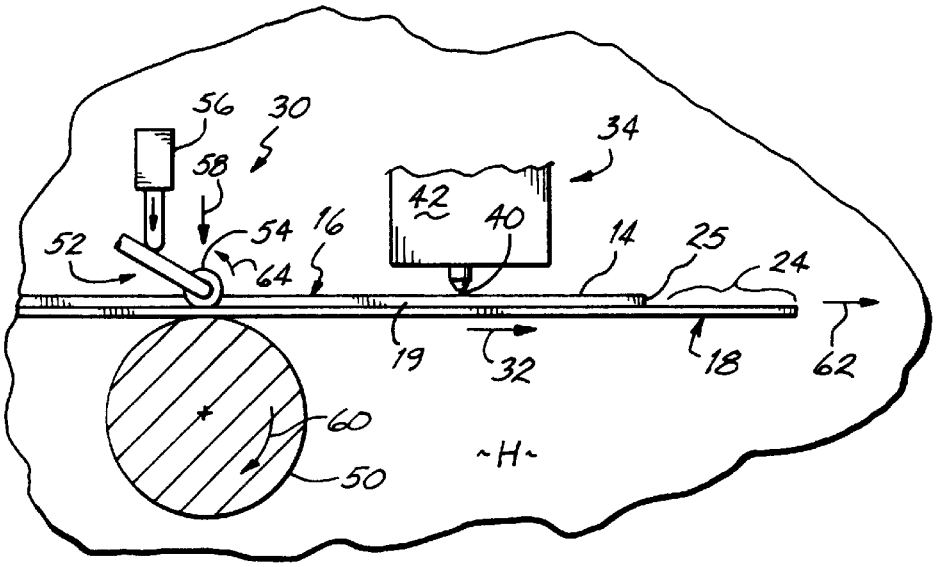
FIG. 1 is a highly schematic, side cross-sectional view showing the paper-drive and printer mechanisms of a printer for purposes of explaining the principles of the present invention.
Figure 2:
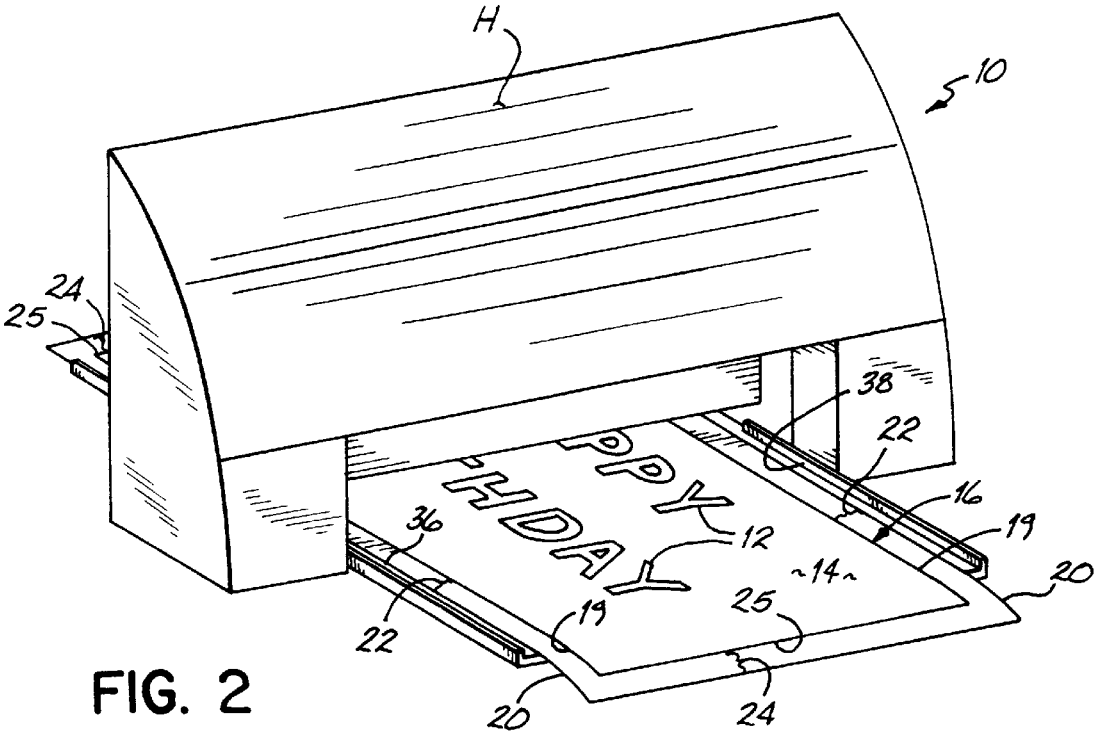
FIG. 2 is a perspective view of the printer of FIG. 1 outputting edible paper with an image printed thereon also for purposes of explaining the principles of the present invention.

With reference to FIGS. 1 and 2, there is shown in schematic form a conventional printer 10 by which to apply a printed image 12 on the upper surface 14 of a sheet of paper 16. For use with the present invention, paper 16 is advantageously a web of edible paper supplied on a substrate sheet 18 such as is described in U.S. patent application Ser. No. 09/166,492, filed Oct. 5, 1998, and entitled "Edible Paper and Method and Apparatus for Making Same", the disclosure of which is incorporated herein in its entirety by reference. As described in the aforesaid patent application, paper 16 is sized smaller than substrate 18 such that the lateral or outboard edges 19 of paper 16 are spaced from the lateral or outboard edges 20 of substrate 18 to thereby define peripheral, lateral substrate margins 22 which are devoid of edible paper 16. Similar substrate margins 24 may also be defined at the front and back edges 25 of paper 16.

Conventional printer 10 includes a housing H in which is held paper-drive mechanism 30 to propel paper 16 and/or substrate 18 lengthwise along a paper path as indicated by arrow 32 so as to pass paper 16 under printer mechanism 34 at which image 12 is applied to the upper surface 14 of edible paper 16 by repeatedly passing mechanism 34 widthwise across paper path 32 and between the outboard edges 36 and 38 thereof, as ink 40 is dispensed from cartridge 42 of printer mechanism 34.

Paper-drive mechanism 30 typically includes a driven roller 50 extending widthwise (into the paper as seen in FIG. 1) across the paper path 32. Mechanism 30 also includes a tension roller assembly 52 supporting a plurality of tension rollers 54 (only one shown in FIG. 1) across the width of the paper path 32. Tension roller assembly 52 also includes one or more bias mechanisms 56 (only one shown in FIG. 1) which independently or collectively urge the tension rollers 54 toward driven roller 50 in the direction of arrow 58 to grip paper 16 and/or substrate 18 therebetween such that as roller 50 is driven in the direction of arrow 60, paper 16 will be propelled lengthwise in the direction of arrow 62 along path 32 as roller(s) 54 counter-rotate in the direction of arrow 64. As paper 16 is so propelled, it will pass under printer mechanism 34 which applies ink(s) 40 such as edible ink from cartridge 42 thereof, to the upper surface 14 of paper 16 to thereby define the image 12 (FIG. 2) thereon by which to have decorated edible paper as desired.

Figure 3:
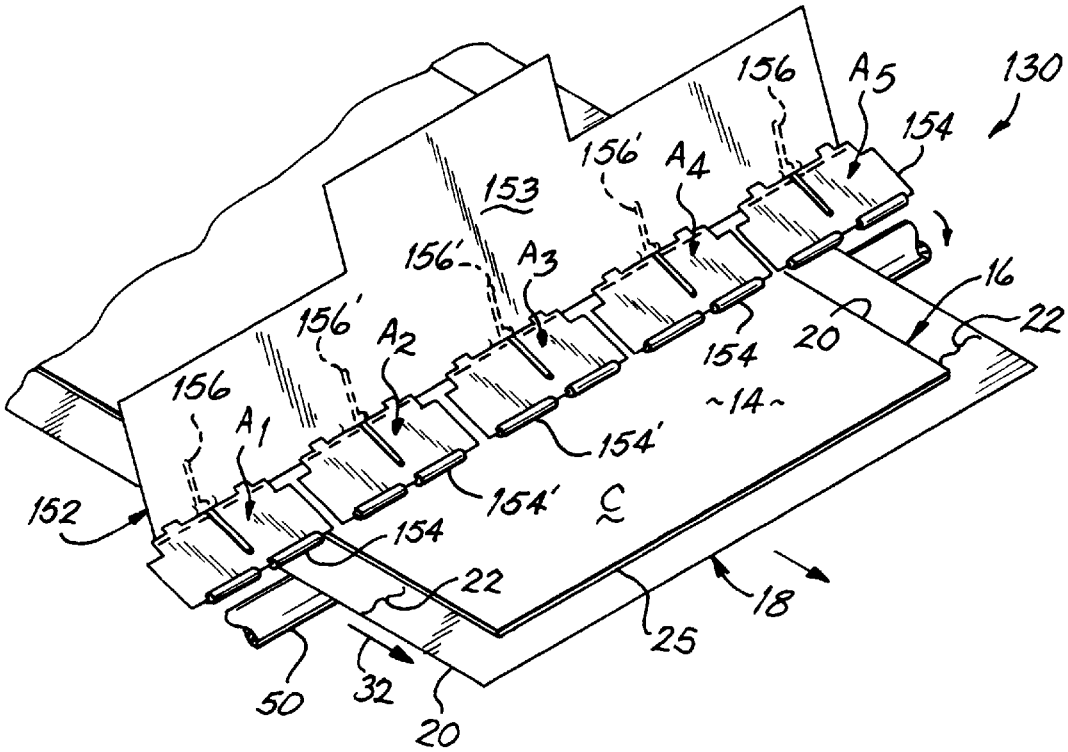
FIG. 3 is a perspective view of one embodiment of a conventional printer paper-drive mechanism.

With reference to FIG. 3, there is shown a perspective view of one embodiment of a conventional printer paper-drive mechanism 130 such as from a Canon 600 Series printer. Drive mechanism 130 includes driven roller 50 situated below paper path 32 and tension roller assembly 152 spaced thereabove so as to capture paper 16 and/or substrate 18 therebetween. To this end, assembly 152 includes a support plate 153 removably attached to the printer housing (not shown in FIG. 3) and rotatably supporting five roller arms $A_1$–$A_5$. Rotatably supported on the outboard arms $A_1$ and $A_5$ are outboard tension rollers 154, and on center roller arms $A_2$–$A_4$ are similarly supported center tension rollers 154'. Tension rollers 154 and 154' are urged toward driven roller 50 by bias a mechanism such as respective springs 156 and 156' which urge arms $A_1$, $A_5$ and $A_2$–$A_4$, respectively, into paper path 32. As will be appreciated from FIG. 3, rollers 154 and 154' extend from outboard edge 36 to outboard edge 38 of paper path 32 such that at least center tension rollers 154' will impinge the central area C of surface 14 of paper 16 between edges 19. As a result, paper 16 may be damaged or become dislodged.

Figure 4:
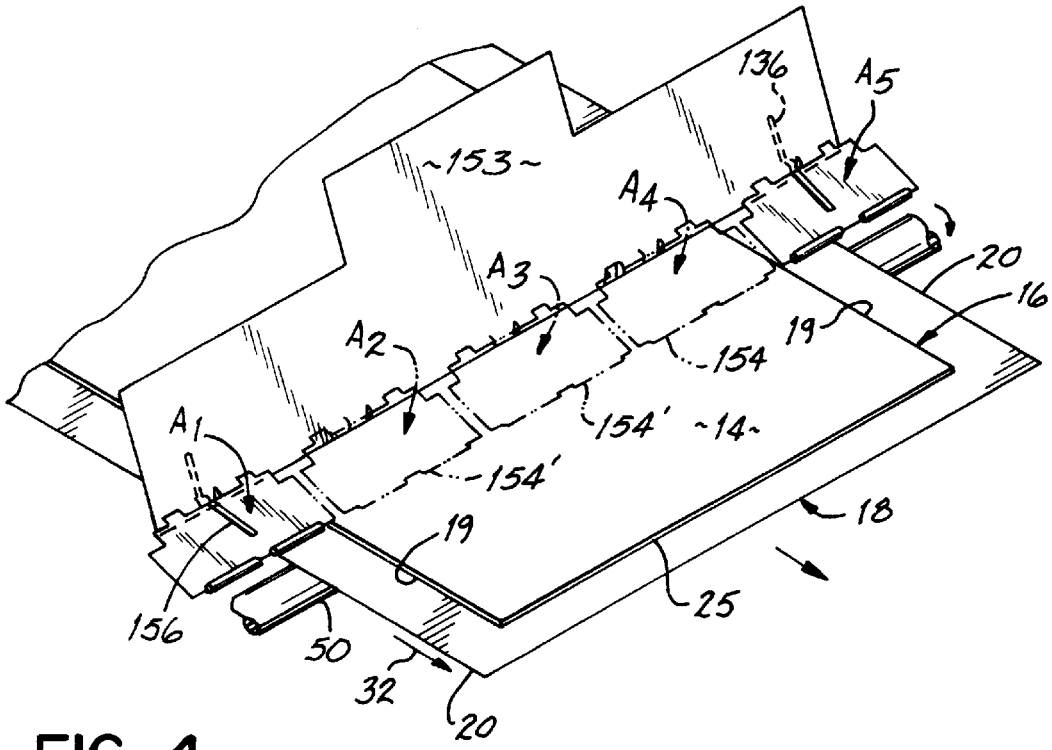
FIG. 4 is a perspective view of the paper-drive mechanism of FIG. 3 with a first modification in accordance with the principles of the present invention.
Figure 5:
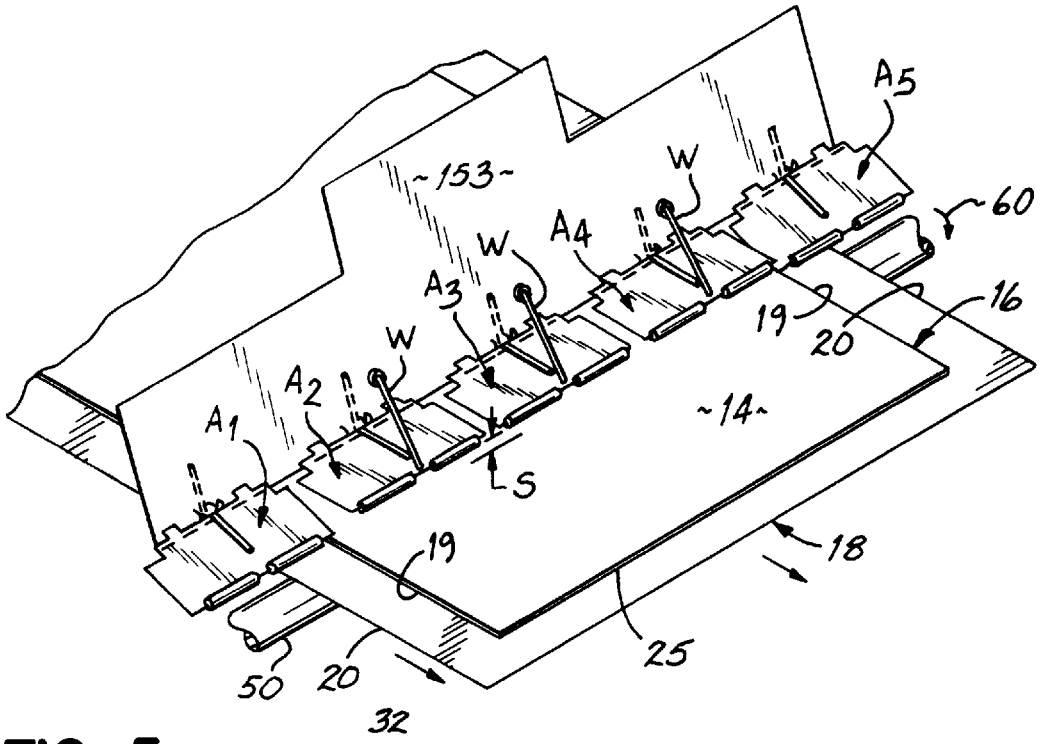
FIG. 5 is a perspective view of the printer-drive mechanism of FIG. 3 with a second, alternative modification in accordance with the principles of the present invention.
Figure 6:
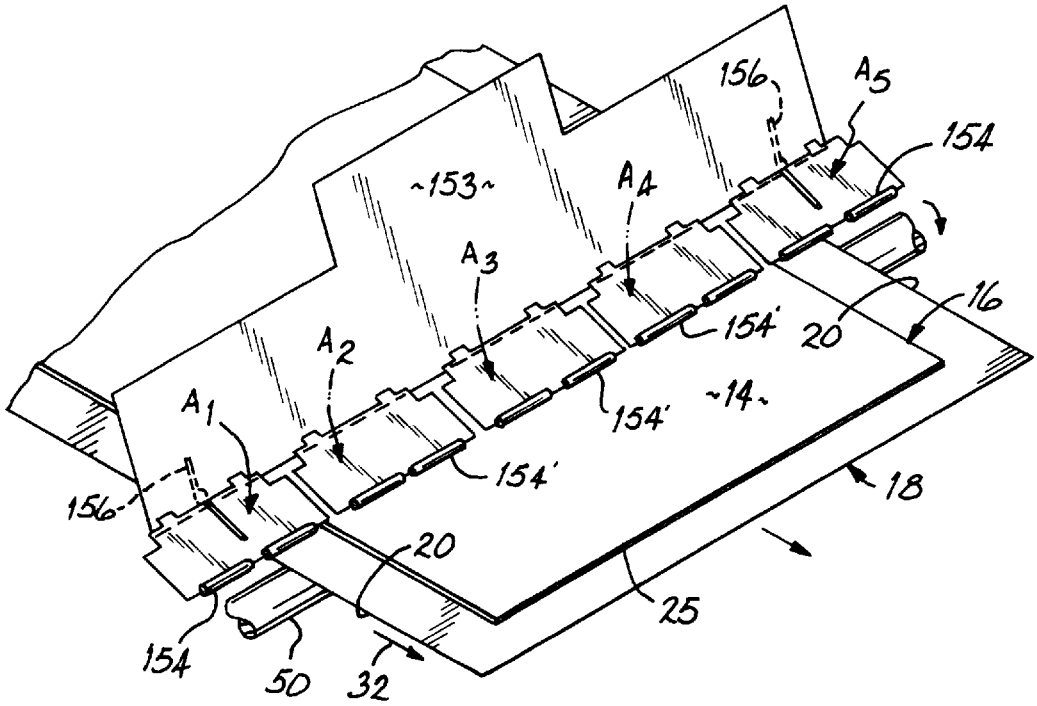
FIG. 6 is a perspective view of the printer-drive mechanism of FIG. 3 with a third, alternative modification in accordance with the principles of the present invention.

To avoid such difficulties, and in accordance with one aspect of the present invention, center tension rollers 154' are to be effectively removed so that they cannot adversely impinge against paper 16. With reference to FIG. 4, one modification to the printer in accordance with the principles of the present invention is to directly remove tension rollers 154' such as by removing roller arms $A_2$–$A_4$ (along with center tension rollers 154' and related bias mechanisms 156') such that the paper path 32 is free of center tension rollers 154'. Thus as exemplified by FIG. 4, substrate 18 may be propelled lengthwise in direction 62 by impingement of rollers 154 with at least part of substrate margin 22 and generally without impingement on paper 16. As an alternative, tension rollers 154' may be indirectly removed by overcoming or removing the bias affect of springs 156'. To this end, as seen in FIG. 5, each of arms $A_2$–$A_4$ may be lifted out of impingement with paper 16 such as by string, cable or wires W connecting each of arms $A_2$–$A_4$ with support plate 153 to thereby create a gap S by which to reduce or eliminate impingement of rollers 154' as paper 16 passes thereunder. If rollers 154' are physically to be left in the printer, the printer is advantageously modified in accordance with the invention by removing the springs 156' (rather than overcoming the bias thereof) such as shown in FIG. 6 to thereby prevent rollers 154' from being actually urged against paper 16. As will be appreciated from the foregoing, as used herein the term "impingement" refers to a tension roller being urged under pressure against surface 14 of paper 16 rather than merely resting thereagainst such as by gravity.

Figure 7:
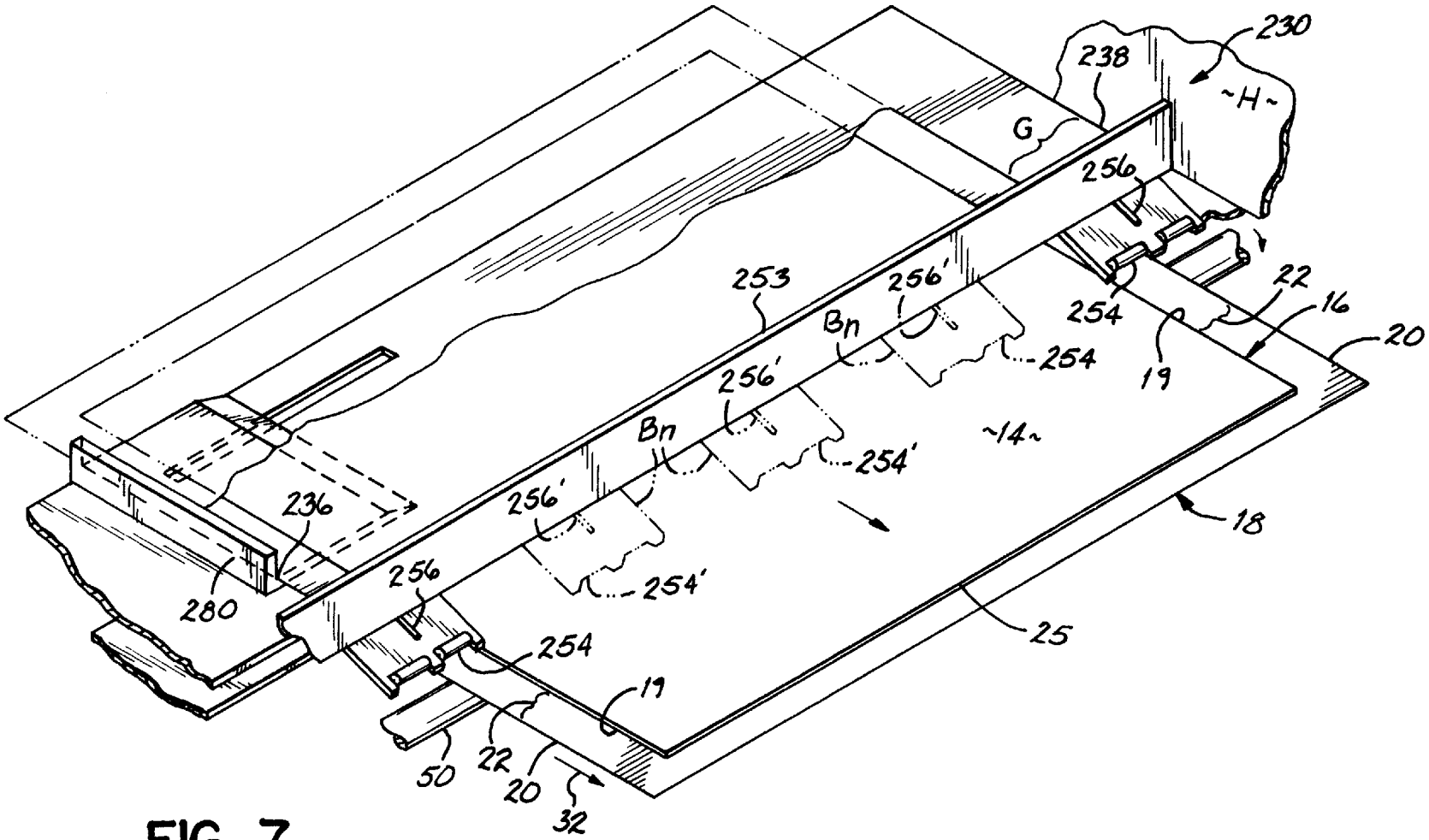
FIG. 7 is a perspective view of a second embodiment of a conventional printer paper-drive mechanism and a conventional, adjustable width inlet associated therewith, showing a first modification to the paper-drive mechanism in accordance with the principles of the present invention.

With reference to FIG. 7, there is shown a second embodiment of a conventional printer paper-drive mechanism 230 (such as from an Epson 800 Series printer), which has been modified in the same manner as FIG. 4 to directly remove center tension rollers 254' by removal of center roller arms $B_n$ and associated bias springs 256' (all as indicated by phantom lines in FIG. 7) from support plate 253 which is secured to printer 10 such as to housing sidewall H. As a consequence, outboard arms $B_1$ and $B_5$, and their associated tension rollers 254 and bias springs 256, remain by which to cooperate with driven roller 50 to propel paper 16 and/or substrate 18 lengthwise through paper path 32 in the direction of arrow 62. Alternatively, center tension rollers 254' could be indirectly removed by overcoming or removing the biasing springs 256' as done with paper-drive mechanism 130 in FIGS. 5 and 6, respectively.

Figure 8:
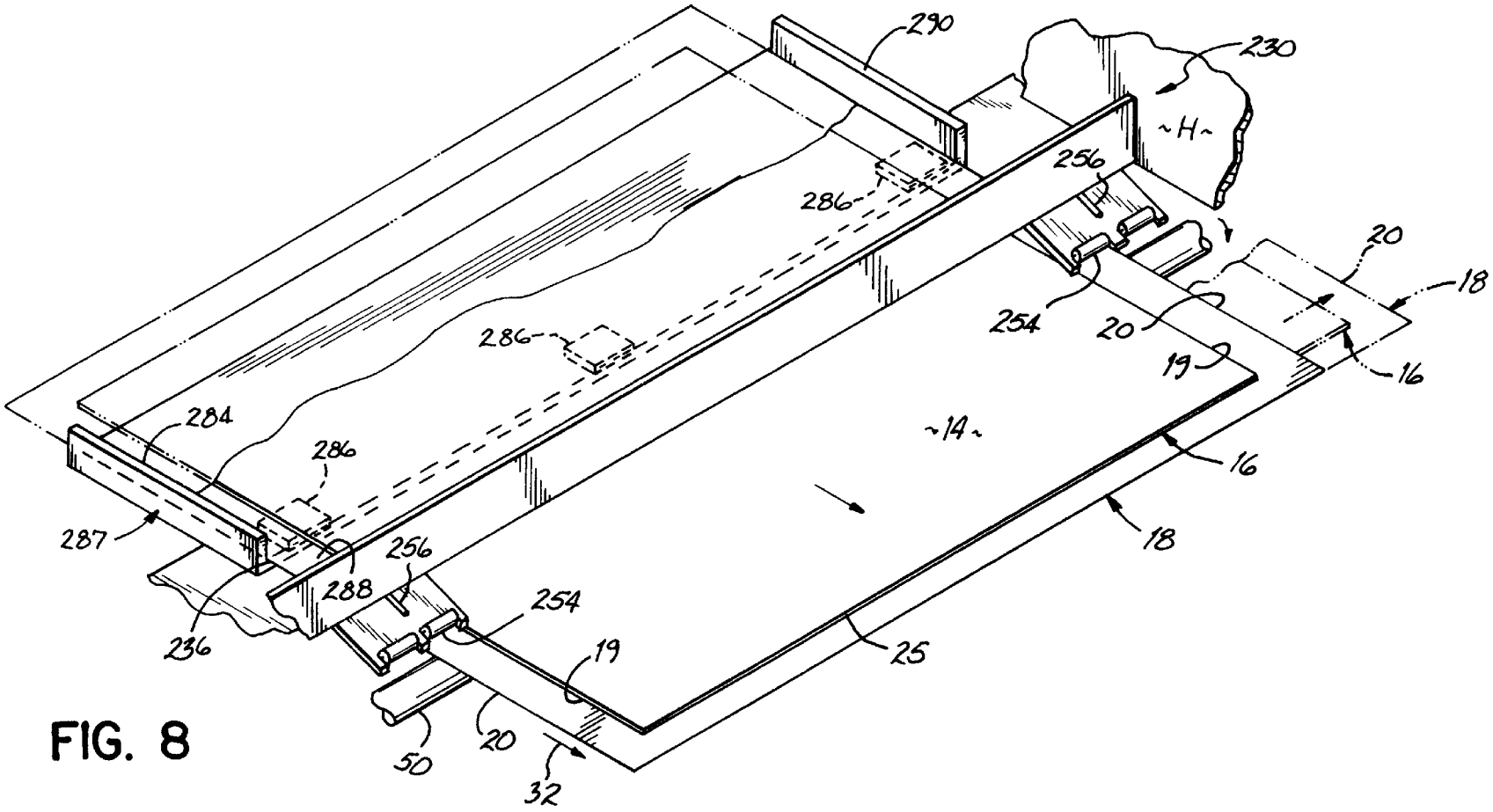
FIG. 8 is a view like FIG. 7 with and a supplemental fixed width tray in accordance with the principles of the present invention.

With further reference to FIG. 7, it may be seen that outboard edge 238 of paper path 32 is fixed or defined by housing sidewall H. The other outboard edge 236 is variable and defined by the position of adjustable stop 280. As will be readily appreciated, if stop 280 is not properly positioned, substrate 18 may be misaligned along paper path 32 and so can cause a jam within the printer. To reduce the likelihood of such a problem, the stop 280 may be immobilized, such as with glue (not shown), so as fix the location on edge 236 at a predetermined spacing from edge 238 to match the known width of substrate 18. Alternatively, and with reference to FIG. 8, it may be seen that a supplemental Delrin plastic tray 282 may be provided having at least one fixed, upstanding edge wall 284. Tray 282 is glued or otherwise affixed (e.g., with three pieces of double sided tape 286) to the inlet 288 of paper path 32 with edge wall 284 positioned to define the location of inlet edge 236 and tray 282 squared up to the paper path 32.

As will also be appreciated from FIG. 7, it is advantageous to position substrate 18 such that margins 22 pass under remaining tension rollers 254. However, were edge wall 284 positioned for that purpose, fixed edge 238 would be too far away leaving a gap G between inlet edge 238 and substrate edge 20. The result would be misalignment and a likely jam. On the other hand, were substrate 18 aligned with edge 20 against fixed inlet edge 238, it may be seen that the associated edge 19 of paper 16 would pass under, and therefore be impinged and possibly damaged by, one of the tension rollers 254 adjacent that outboard edge (as also shown in phantom line in FIG. 7). Provision of supplemental tray 282 with a second fixed, upstanding edge wall 290 spaced a distance from edge wall 284 equal to the width of substrate 18 redefines the edge location of substrate 18 from edge 238 to wall 290 as if to define a new outboard edge 290 of paper path 32 to thereby position margin(s) 22 to pass under respective tension rollers 254 without impinging on paper 16, as exemplified in FIG. 8.

In some cases, removal of the center tension rollers (directly or indirectly as discussed above) and/or redefining and fixing the outboard edges of the paper path (such as with supplemental tray 282) may not be sufficient to completely avoid impingement of paper 16 with an outboard tension roller. In this regard, and with reference to FIG. 9, it may be seen that in some printers, such as a Canon 4000 Series printer, the tension roller assembly 352 of drive mechanism 330 includes tension rollers 354 and 354' that are so long or wide that at least some portion of one or both outboard tension rollers 354 will overlie, and could thus adversely impinge, paper 16 on substrate 18. To this end, assembly 352 of mechanism 330 includes a resilient, plastic support plate 353 affixed to the printer housing H, which plate rotatably supports directly thereon left and right outboard tension pin rollers 354, and three center tension pin rollers 354' spaced therebetween. Also, assembly 352 includes a plurality of bias springs 356 and 356' which flex plate 353 downwardly so as to urge tension pin rollers 354 and 354' towards driven roller 50. In accordance with the principles of the invention, center tension pin rollers 354' and/or three center bias springs 356' may be removed to thereby relieve pressure against paper 16 as it passes thereunder (see FIG. 10). However, it may be seen that tension pin rollers 354 are sufficiently long that at least an inner portion I thereof overlies paper 16 adjacent margin 22 (see FIG. 11).

To overcome the drawbacks that could arise from impinging even the edges 19 of paper 16 by long or wide tension rollers, outboard tension rollers 354 are also removed from plate 353 and modified (or replaced with similarly modified pin rollers) as will now be described. More particularly, with reference to FIG. 10, it is seen that each roller 354 defines a cylinder of a nominal diameter. The outboard portions O of tension pin rollers 354 are thickened, such as by sliding a concentric stainless steel sleeve 400 (e.g., a tube of Eagle Part No. S0125020T316WHL) thereover. Each sleeve 400 should be unbent and have its ends deburred and slightly chamfered. Sleeves 400 are held in place on roller 354 with adhesive (such as McMaster Carr Loctite Prism 411 #74765A43). The modified pin rollers 354 (or similar appearing rollers having a cylinder with a thickened portion as at O) are then replaced in plate 353. As may be seen in FIG. 11, sleeve 400 increases the nominal cylinder diameter of roller portions O by an amount sufficient to elevate the remaining inboard portions I thereof at or above the level of the surface 14 of paper 16 thereby reducing or eliminating impingement by outboard tension pin rollers 354 with paper 16. It will be readily appreciated that outboard-thickened tension rollers may alone suffice to avoid impingement of center tension rollers 354' without removal of same, although springs 356' may still advantageously be removed to further reduce the risk of impingement thereof with paper 16.

Figure 9:
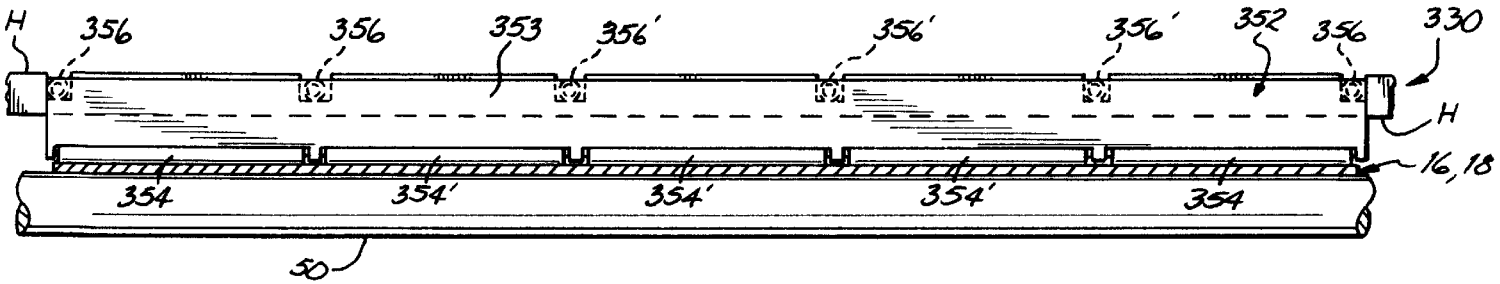
FIG. 9 is a front view of a third embodiment of a conventional printer paper-drive mechanism.
Figure 10:
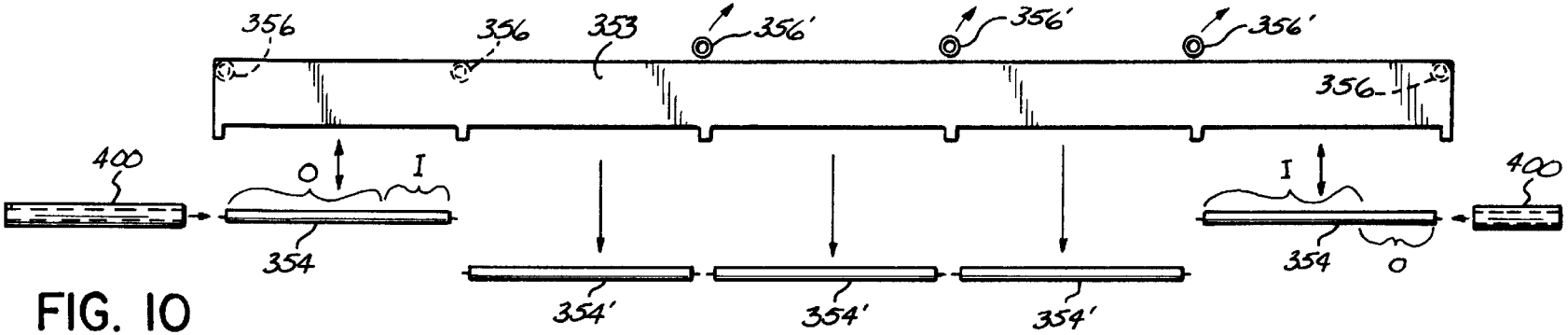
FIG. 10 is an exploded view of the tension roller assembly of the paper-drive mechanism of FIG. 9 for purposes of explaining modifications thereto in accordance with the principles of the present invention.
Figure 11:
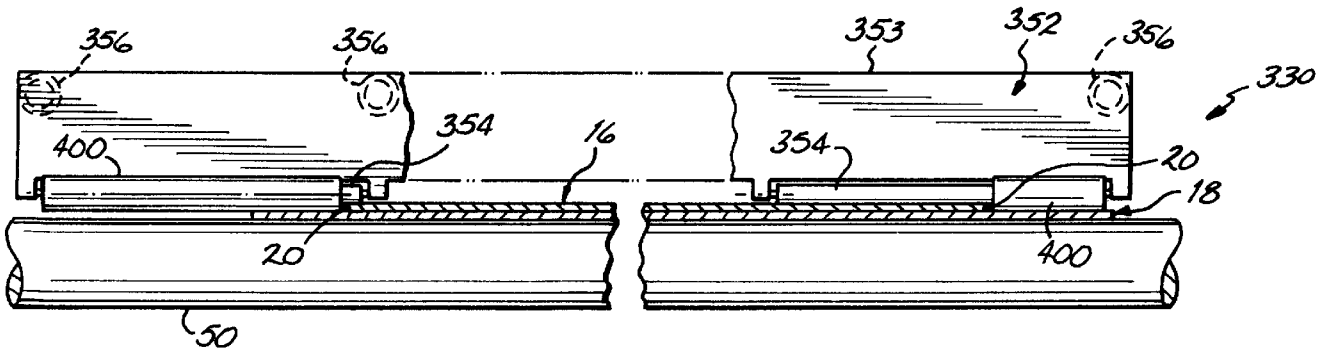
FIG. 11 is a front view of the paper-drive mechanism of FIG. 9 modified as explained in connection with FIG. 10.

In the embodiment shown in FIGS. 9 and 11, it is seen that paper 16 is not ideally centered between the outboard edges of the paper path. Hence, the extent of the thickened portions O of the respective tension pin rollers 354 may not be the same. In this regard, left pin roller 354 (as seen in FIGS. 10 and 11) is provided with a 1½ inch length of tube 400, whereas right pin roller 354 is provided with a ⅝ inch length of tube 400.

In use, a printer is modified by reducing the ability of the central tension rollers to impinge against edible paper 16 passing thereunder. Such modification is accomplished by effectively removing one or more of the center tension rollers (e.g., 154', 254', or 354') either directly such as by removing the associated center tension roller arm(s), along with the tension rollers and associated bias springs; or indirectly such as by overcoming or removing the associated center bias spring(s). Additionally, or alternatively, one or both outboard tension rollers are provided with a thickened outboard portion so as to elevate the inwardly portion thereof above substrate 18 so as to reduce or avoid impingement with edges 19 of paper 16 passing thereunder. In order to further reduce paper jams and the like, the adjustable stop 280, if any, may be fixed in location. Alternatively, or additionally, a supplemental tray 282 is affixed the inlet of the paper path 32 so as to fix one or both lateral edges of the inlet to the paper path, thereby better aligning substrate 18 with paper path 32 and/or offsetting substrate 18 relative to a fixed edge 238 of paper path 32 so as to minimize the extent of paper 16 passing under the outboard tension rollers. The substrate is placed onto the tray 282 and, by cooperation of driven roller 50 and the remaining outboard tension rollers 154, 254, or 354, at least part of margins 22 of substrate 18 are gripped to propel substrate 18 and thus paper 16 lengthwise along paper path 32 and under printer mechanism 34 (see FIG. 1) without adversely impinging on the surface 14 of paper 16 to thereby output paper 16 with decoration 12 printed on the surface 14 of paper 16 as seen in FIG. 2.

After the image 12 is reproduced onto surface 14 of paper 16, paper 16 may be peeled from substrate 18. Decorated paper 16 is then laid (with surface 14 up), onto the icing or frosting of an iced baked good such as a cake (not shown) after which the iced cake may be cut and served in any desired fashion. As paper 16 and the inks forming the image 12 thereon are edible, they may be consumed along with cake. As will be appreciated, edible inks must be nontoxic so that they do not render the printed image essentially inedible. Advantageously, the inks 40 are edible inks which include FDA approved FD&C dyes. Further advantageously, inks containing an effective amount of isopropyl or ethyl alcohol which evaporates during the printing process are used. Such inks also maintain sterility of the inks while in the cartridge 42 and yet cause a fast drying effect of the ink as it is applied by the printer. The basic formulation of such inks is 5% isopropyl or ethyl alcohol, 8% glycerin, FD&C food color as appropriate, with the balance comprised of distilled water.

Paper 16 may have a width measured between edges 19 of about 7 inches and a length measured between edges 25 of about 10¼ inches. Substrate 18 may have a larger width measured between edges 20 of about 8½ inches and a larger length of about 11 inches such that side or lateral margins 22 are each about ¾ inches wide and at least first margin 24 is about ⅜ inches long. Tray 282 may be defined by a 1⅞ inch by 8 13/16 inch web of ⅛ inches thick Delrin white plastic with three spaced pieces of tape 286 near the front edge thereof to attach to inlet 288 of the paper path 32. Tray 282 has fixed edge walls 284 and 290 each being about ⅛ inch thick and ⅛ inch tall such that the spacing therebetween is about 8 9/16 inch to correspond to the width of substrate 18 as above-described.

By virtue of the foregoing, there is thus provided method and apparatus, such as modifications to conventional printers, by which to reduce problems encountered as edible paper passes through the paper path of the printer.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, while the printers specifically referenced herein are of the ink jet-type (i.e., liquid ink is dispensed from a cartridge such as is found in ink jet and bubble jet printers), the principles of the invention are applicable to other printer types as well. And while both outboard tension rollers (154, 254, or 354) are shown as being left in place, in some situations, only one side may need to be left in place, and fewer then all of the center tension rollers (154', 254', or 354') may need to be removed (such as only one) depending upon the type and size of edible paper. Still further, the modifications described herein may be used as alternatives or in combination (such as by directly removing one of the center tension rollers while indirectly removing others). The invention in its broader aspects is, therefore, not limited to the specific details, representative apparatus and methods, and illustrative examples shown and described. Accordingly, departures may be made from such details without departing from the spirit or scope of the general inventive concept.

Having described the invention, what is claimed is:

1. A method of modifying a printer to handle edible paper, the printer having a paper path along which the edible paper is to be propelled and a paper-drive mechanism including a plurality of tension rollers extending across the paper path between opposite outboard edges thereof, at least a first of the tension rollers being an outboard tension roller positioned adjacent one of the outboard edges of the paper path and at least a second of the tension rollers being a center tension roller positioned away from the outboard edges of the paper path, the method comprising:

removing the center tension roller from the paper path before propelling the edible paper along the paper path with the outboard tension roller maintained within the paper path.

2. The method of claim 1 wherein removing the center tension roller includes removing the center tension roller from the paper-drive mechanism.

3. The method of claim 2 wherein the paper-drive mechanism includes a plurality of tension arms, each supporting at least a respective one of the tension rollers, and wherein removing the center tension roller includes removing the tension arm supporting the center tension roller from the paper-drive mechanism.

4. The method of claim 2 wherein the paper-drive mechanism includes a bias mechanism urging the center tension rollers into the paper path, the method further comprising removing the bias mechanism from the paper-drive mechanism.

5. The method of claim 2 wherein the paper-drive mechanism includes a support plate supporting the tension rollers, and wherein removing the center tension roller includes removing the center tension roller from the support plate.

6. The method of claim 1 wherein removing the center tension roller includes removing the center tension roller from the paper path without removing the center tension roller from the paper-drive mechanism.

7. The method of claim 6 wherein the paper-drive mechanism includes a bias mechanism urging the center tension roller into the paper path, and wherein removing the center tension roller from the paper path without removing the center tension roller from the paper-drive mechanism includes overcoming the bias mechanism.

8. The method of claim 6 wherein the paper-drive mechanism includes a bias mechanism urging the center tension roller into the paper path, and wherein removing the center tension roller from the paper path without removing the center tension roller from the paper-drive mechanism includes removing the bias mechanism from the paper-drive mechanism.

9. The method of claim 6 wherein removing the center tension roller from the paper path without removing the center tension roller includes thickening a portion of the outboard tension roller.

10. The method of claim 1 further comprising thickening a portion of the outboard tension roller.

11. The method of claim 1 wherein the paper path has an inlet sized larger than the width of the edible paper and any supporting substrate, the method further comprising fixing the inlet size to match the edible paper width and any supporting substrate.

12. The method of claim 1 wherein the edible paper is carried on a substrate with the paper having a first width and the substrate having a second, larger width so as to define along at least one edge of the substrate a margin devoid of the edible paper, the method further comprising positioning the substrate relative to the paper path such that at least part of the margin of the substrate, rather than the edible paper, passes under the outboard tension roller.

13. The method of claim 1 wherein at least a third of the tension rollers is also a center tension roller positioned away from the outboard edges of the paper path such that there is a plurality of such center tension rollers, the method further comprising removing the plurality of center tension rollers from the paper path before propelling the edible paper along the paper path.

14. A method of modifying a printer to handle edible paper, the printer having a paper path along which the edible paper is to be propelled and a paper-drive mechanism including a plurality of tension rollers extending across the paper path between opposite outboard edges thereof, at least a first of the tension rollers being an outboard tension roller positioned adjacent one of the outboard edges of the paper path and at least a second of the tension rollers being a center tension roller positioned away from the outboard edges of the paper path, the method comprising:

thickening at least a portion of the outboard tension roller.

15. The method of claim 14 wherein the thickened portion of the tension roller is an outboard portion thereof, the method including leaving an inwardly portion of the outboard tension roller unthickened.

16. The method of claim 15 wherein the edible paper is carried on a substrate with the paper having a first width and the substrate having a second, larger width so as to define along at least one edge of the substrate a margin devoid of the edible paper, the method further comprising positioning the substrate, rather then the edible paper, relative to the paper path such that at least part of the margin of the substrate passes under the thickened portion of the outboard tension roller and at least a part of the edible paper passes under the unthickened portion of the outboard tension roller.

17. The method of claim 14 wherein the edible paper is carried on a substrate with the paper having a first width and the substrate having a second, larger width so as to define along at least one edge of the substrate a margin devoid of the edible paper, the method further comprising positioning the substrate relative to the paper path such that at least part of the margin of the substrate, rather than the edible paper, passes under the thickened portion of the outboard tension roller.

18. The method of claim 14 wherein the paper-drive mechanism includes a bias mechanism urging the center tension roller into the paper path, the method further including removing the bias mechanism from the paper-drive mechanism.

19. The method of claim 14 wherein the paper path has an inlet sized larger than the width of the edible paper and any supporting substrate, the method further comprising fixing the inlet size to match the edible paper width and any supporting substrate.

20. The method of claim 14 wherein a third of the tension rollers is an outboard tension roller positioned adjacent another of the outboard edges with the center roller situated between both of the outboard tension rollers, the method further comprising thickening at least a portion of both of the outboard tension rollers.

21. A method of modifying a printer to handle edible paper, the printer having a paper path along which the edible paper is to be propelled and a paper-drive mechanism, the paper path having a first outboard edge and a second, oppositely disposed outboard edge, the printer further having a movable stop to define the second outboard edge, the method comprising:

permanently immobilizing the stop from manual movement so as to fix the second outboard edge.

22. The method of claim 21 wherein the paper drive mechanism has a tension roller situated adjacent the first outboard edge, the method further comprising adding an edge wall spaced from the first outboard edge and laterally aligned with the outboard tension roller so as to offset the edible paper from the first outboard edge.

23. A method of modifying a printer to handle edible paper, the printer having a paper path along which the edible paper is to be propelled and a paper-drive mechanism, the paper path having a first outboard edge and a second, oppositely disposed outboard edge, the paper-drive mechanism having a tension roller situated adjacent one of the outboard edges, the method comprising:

adding first and second spaced-apart, fixed edge walls to define new first and second outboard edges of the paper path.

24. The method of claim 23 further comprising adding at least the first edge wall spaced from the first outboard edge and laterally aligned with the outboard tension roller so as to offset the edible paper from the first outboard edge.

25. A printer in combination with a sheet of edible paper carried on a substrate wherein said edible paper has a first width and said substrate has a second, larger width so as to define along at least one edge of said substrate a margin devoid of said edible paper, the printer comprising:

a paper path along which to carry said substrate and edible paper, the paper path having a width extending between opposite outboard edges large enough to allow said substrate to traverse the paper path;

a print dispensing mechanism to apply visually perceptible images onto said edible paper as said substrate traverses the paper path; and a paper-drive mechanism to propel said substrate along the paper path and including a first tension roller rotatably supported over the paper path adjacent one of the outboard edges to facilitate propelling said substrate by impinging on said margin thereof, the paper-drive mechanism being devoid of tension rollers rotatably centrally supported in the paper path and centrally located between the outboard edges whereby to substantially avoid impinging on said edible paper as said substrate is propelled along the paper path.

26. A printer in combination with a sheet of edible paper carried on a substrate wherein said edible paper has a first width and said substrate has a second, larger width so as to define along at least one edge of said substrate a margin devoid of said edible paper, the printer comprising:

a paper path along which to carry said substrate and edible paper, the paper path having a width extending between opposite outboard edges large enough to allow said substrate to traverse the paper path;

a print dispensing mechanism to apply visually perceptible images onto said edible paper as said substrate traverses the paper path; and a paper-drive mechanism to propel said substrate along the paper path and including a first tension roller rotatably supported over the paper path adjacent one of the outboard edges to facilitate propelling said substrate by impinging on said margin thereof, the first tension roller having a cylinder extending between its ends, the cylinder having a nominal diameter portion and an oversized diameter portion, the first tension roller being positioned adjacent said outboard edge at an outer end of the tension roller with the oversized diameter portion immediately adjacent the outboard edge so as to impinge said substrate margin and the nominal diameter portion spaced away from the outboard edge at an inner end of the first tension roller so as to overlie said edible paper, the oversized diameter portion causing the nominal diameter portion to the elevated whereby to substantially avoid impinging on said edible paper as said substrate is propelled along the paper path.

27. A printer in combination with a sheet of edible paper carried on a substrate wherein said edible paper has a first width and said substrate has a second, larger width so as to define along at least one edge of said substrate a margin devoid of said edible paper, the printer comprising:

a paper path along which to carry said substrate and edible paper, the paper path having a width extending between opposite first and second outboard edges large enough to allow said substrate to traverse the paper path;

a print dispensing mechanism to apply visually perceptible images onto said edible paper as said substrate traverses the paper path;

a paper-drive mechanism to propel said substrate along the paper path and including a first tension roller rotatably supported over the paper path adjacent the first outboard edge; and an added edge wall near the first outboard edge to define a new outboard edge laterally aligned with the first tension roller whereby to offset said edible paper and substrate from the first outboard edge such that at least a part of said substrate margin, rather than the said edible paper, passes under the first tension roller.

28. A printer in combination with a sheet of edible paper carried on a substrate wherein said edible paper has a first width and said substrate has a second, larger width so as to define along at least one edge of said substrate a margin devoid of said edible paper, the printer comprising:

a paper path along which to carry said substrate and edible paper, the paper path having a width extending between opposite outboard edges large enough to allow said substrate to traverse the paper path;

a print dispensing mechanism to apply visually perceptible images onto said edible paper as said substrate traverses the paper path; and a paper-drive mechanism to propel said substrate along the paper path and including a first tension roller rotatably supported over the paper path adjacent one of the outboard edges to facilitate propelling said substrate by impinging on said margin thereof, the paper-drive mechanism further including a central tension roller centrally supported over the paper path and centrally located between the outboard edges, the paper-drive mechanism configured to not urge the central tension roller under pressure against said edible paper whereby to substantially avoid impinging on said edible paper as said substrate is propelled along the paper path.

29. The printer of claim 28, the paper-drive mechanism including a first bias mechanism to urge the first tension roller into the paper path, the paper-drive mechanism being devoid of a bias mechanism to urge the center tension roller into the paper path.

30. The printer of claim 28, the paper-drive mechanism including a first bias mechanism to urge the first tension roller into the paper path, the paper-drive mechanism further including a bias mechanism to urge the center tension roller into the paper path, the printer further including means overcoming the bias mechanism of the center tension roller whereby to substantially avoid the center tension roller impinging on said edible paper.

* * * * *

UNITED STATES PATENT AND TRADEMARK OFFICE

CERTIFICATE OF CORRECTION

PATENT NO. : 6,030,134

DATED : February 29, 2000

INVENTOR(S) : Douglas R. Stewart

It is certified that errors appear in the above-identified patent and that said Letters Patent is hereby corrected as shown below:

In column 4, line 13, please delete "with and a" and replace with --with a--;

In column 5, line 16, please delete "by bias a mechanism" and replace with --by a bias mechanism--;

In column 6, line 11, please delete "so as fix" and replace with --so as to fix--;

In column 10, line 19 (claim 16, line 6), please delete "rather then the" and replace with --rather than the--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*